US005461287A

United States Patent [19]

Russell et al.

[11] Patent Number: 5,461,287

[45] Date of Patent: Oct. 24, 1995

[54] BOOSTER DRIVEN INVERTER BALLAST EMPLOYING THE OUTPUT FROM THE INVERTER TO TRIGGER THE BOOSTER

[75] Inventors: Randy G. Russell, Glen Ellyn; Peter W. Shackle, Arlington Heights; Kent E. Crouse, Hanover Park, all of Ill.

[73] Assignee: Energy Savings, Inc., Schaumburg, Ill.

[21] Appl. No.: 202,053

[22] Filed: Feb. 25, 1994

[51] Int. Cl.[6] ..... H05B 37/02

[52] U.S. Cl. ..... 315/209 R; 315/247; 315/DIG. 5; 315/DIG. 7; 315/224; 315/307

[58] Field of Search ..... 315/247, 291, 315/307, DIG. 5, DIG. 7, 209 R, 219, 224

[56] References Cited

U.S. PATENT DOCUMENTS

| | | | |
|---|---|---|---|
| Re. 32,901 | 4/1989 | Nilssen | 315/244 |
| 4,277,728 | 7/1981 | Stevens | 315/247 |
| 4,463,286 | 7/1984 | Justice | 315/219 |
| 4,513,226 | 4/1985 | Josephson | 315/DIG. 7 |
| 5,051,662 | 9/1991 | Counts | 315/247 |
| 5,353,214 | 10/1994 | Kim | 315/DIG. 7 |

*Primary Examiner*—Benny Lee
*Assistant Examiner*—Michael Shingleton
*Attorney, Agent, or Firm*—Cahill, Sutton & Thomas

[57] ABSTRACT

An electronic ballast includes a triggered boost circuit, a driven inverter, and a low voltage signal generator in a a half-bridge, push-pull, series resonant, parallel loaded configuration. The boost circuit is triggered by a voltage from the inverter and the inverter is controlled by the low voltage signal generator. The boost circuit includes a low voltage output for powering the signal generator. In the event of a fault, the operation of the signal generator is interrupted, thereby shutting off the boost circuit and the inverter. A DC blocking capacitor is in series with the lamps and a resistor is connected in parallel with the DC blocking capacitor. The ballast is started by a pulse of displacement current through the lamp filaments to the boost circuit. Since the lamp filaments must be intact, the ballast does not begin a lamp starting sequence until lamps are connected to the ballast.

7 Claims, 2 Drawing Sheets

BOOSTER DRIVEN INVERTER BALLAST EMPLOYING THE OUTPUT FROM THE INVERTER TO TRIGGER THE BOOSTER

BACKGROUND OF THE INVENTION

1. Field of Invention

This invention relates to electronic ballasts for fluorescent lamps and, in particular, to electronic ballasts which stop operating in response to a fault condition such as a defective lamp or a missing lamp.

2. Prior Art

A gas discharge lamp, such as a fluorescent lamp, is a non-linear load to a power line, i.e. the current through the lamp is not directly proportional to the voltage across the lamp. Current through the lamp is zero until a minimum voltage is reached, then the lamp begins to conduct. Once the lamp conducts, the current will increase rapidly unless there is a ballast in series with the lamp to limit current.

A resistor can be used as a ballast but a resistor consumes power, thereby decreasing efficiency, measured in lumens per watt. A "magnetic" ballast is an inductor in series with the lamp and is more efficient than a resistor but is physically large and heavy. A large inductor is required because impedance is a function of frequency and power lines operate at low frequency (50–60 hz.)

An electronic ballast typically includes a rectifier for changing the alternating current (AC) from a power line to direct current (DC) and an inverter for changing the direct current to alternating current at high frequency, typically 25–60 khz. Since a frequency much higher than 50–60 hz. is used, the inductors for an electronic ballast can be much smaller than the inductors for a magnetic ballast.

Converting from alternating current to direct current is usually done with a full wave or bridge rectifier. A filter capacitor on the output of the rectifier stores energy for powering the inverter. The voltage on the capacitor is not constant but has a 120 hz "ripple" that is more or less pronounced depending on the size of the capacitor and the amount of current drawn from the capacitor.

Some ballasts include a boost circuit between the rectifier and the inverter. As used herein, a "boost" circuit is a circuit which increases the DC voltage, e.g. from approximately 180 volts (assuming a 120 volt input) to 300 volts or more for operating a lamp, and/or which provides power factor correction. "Power factor" is a figure of merit indicating whether or not a load in an AC circuit is equivalent to a pure resistance, i.e. indicating whether or not the voltage and current are sinusoidal and in phase. It is preferred that the load be the equivalent of a pure resistance (a power factor equal to one).

If a lamp is not connected to an electronic ballast while power is applied to the ballast, the voltages and currents within the ballast can become extremely high, destroying the ballast. In addition, if a lamp is disconnected from a ballast, the person disconnecting the lamp is exposed to the high voltages of the ballast, e.g. by touching the terminals at one end of the lamp while the other end of the lamp is connected to the ballast. Many ballasts are designed to generate extra high voltages initially, to assure an instantaneous or a rapid start of a lamp, then to reduce the voltage when the lamp is conducting. When a lamp is removed, the circuitry within such ballasts reverts to a start-up mode and produces an extra high output voltage at the very time a person may be touching the terminals of the lamp.

Some electronic ballasts include a transformer in the output stage to isolate the lamp circuit from electrical ground. If a person touches the end of a lamp as he removes it, current cannot flow from the ballast through the lamp and through the person to electrical ground. An isolation transformer makes the ballast heavy and expensive. In addition, if a lamp is removed from such a ballast, the ballast typically reverts to a start-up mode which consumes large amounts of power, electrically and thermally stressing the components of the ballast.

In order to avoid stresses on the ballast, many circuits have been proposed for automatically shutting off the ballast when a fault condition is detected, e.g. a defective lamp or a missing lamp. U.S. Pat. No. 4,507,698 (Nilssen) discloses adding a ground fault interrupter to a ballast. A ground fault interrupter detects current flowing out of the ballast and returning by way of electrical ground rather than through the output terminals of the ballast. Since only a fraction of the current may return this way, the detection circuitry must be quite sensitive. Precise components must be used to avoid false triggering of the interrupter and these components significantly increase the cost of a ballast.

Other electronic ballasts include circuitry for monitoring voltage or current within the ballast and for shutting off the ballast when a fault is detected. A problem with such circuitry is that shutting off the ballast does not mean that the fault is corrected. Some ballasts resolve this problem by requiring that the applied power be turned off and then on in order for the ballast to restart, i.e. the ballast turns off and remains off until power is removed, starting normally when power is applied. Other ballasts enter a start mode after a predetermined length of time, typically a few seconds, and then periodically attempt to restart until turned off or until the fault is corrected.

Some ballasts do not turn off completely but only shut off the inverter. Other ballasts, if they have a voltage boost circuit, also shut off the boost circuit. If a fault is detected, it is desired to minimize power consumption by shutting off as much of the ballast as possible. This often requires a large number of components, increasing the cost of the ballast and often increasing power consumption when the ballast is operating normally.

A boost circuit and the inverter can each be self-oscillating, triggered, or driven. A driven circuit requires a source of pulses for operation and the pulses are provided by a timer circuit or a more complicated integrated circuit designed for ballasts or electronic power supplies. A triggered circuit typically incorporates a small pulse generator for starting the circuit into oscillation. A capacitor charging up to the firing voltage of a diac or other semiconductor switch is typically used in such circuits. The pulse generator may or may not be disabled when the ballast is operating normally. A self-oscillating circuit is constructed in such a way that the applied voltage causes the circuit to begin oscillation and typically includes a resistor having a high resistance to provide a temporary bias for initiating oscillation.

U.S. Pat. No. 4,562,383 (Kirscher et al.) discloses an electronic ballast in which a driven boost circuit is coupled to a triggered inverter for synchronous operation. An auxiliary winding on an output transformer senses excess voltage and triggers an SCR into a latched state to disable the inverter and the boost circuit if a lamp is removed. A disadvantage of a latched SCR is the continuous holding current through the SCR which causes unnecessarily high power dissipation and requires the use of expensive, high power resistors in the ballast. The coupling between the boost circuit and the inverter limits the amount of power factor correction which can be obtained from the ballast.

U.S. Pat. No. 4,554,487 (Nilssen) discloses an electronic ballast including a triggered inverter in which a portion of the inverter circuit is short circuited in the event of excess voltage across the output terminals. The inverter stays off until power is removed and then reapplied. This approach is impractical for commercial applications, e.g. re-lamping a department store or office building would entail turning off all of the lights seriatim.

U.S. Pat. No. 5,117,161 (Avrahami) discloses a self-oscillating inverter having two series connected switching transistors operating in push-pull. A resistor is also connected in series with the switching transistors. If the voltage drop across the series resistor exceeds a predetermined amount, a flip-flop circuit is set and the output signal from the flip-flop circuit causes a transistor to short circuit a portion of the inverter, quenching oscillation. An external signal is required for re-starting the inverter.

In view of the foregoing, it is therefore an object of the invention to provide an electronic ballast which automatically shuts off in the event of a fault without dissipating large amounts of power.

Another object of the invention is to provide an electronic ballast including automatic shut-off circuitry which dissipates very little power either during a fault condition or during normal operation of the ballast.

A further object of the invention is to provide an electronic ballast which includes minimal circuitry for shutting off the ballast in the event of a fault and which requires no additional circuitry for re-starting the ballast when the fault is corrected.

Another object of the invention is to provide an electronic ballast which uses a boost circuit to provide a low voltage for operating integrated circuits within the ballast.

A further object of the invention is to provide an electronic ballast in which a brief displacement current through a capacitor in series with the lamp filaments starts a self-oscillating boost circuit and turns on the ballast.

Another object of the invention is to provide an electronic ballast which enters a quiescent state when a fault is detected, thereby drawing little or no power.

SUMMARY OF THE INVENTION

The foregoing objects are achieved in an electronic ballast including a triggered boost circuit, a driven inverter, and a low voltage signal generator in a half-bridge, push-pull, series resonant, parallel loaded configuration. The boost circuit is triggered by a voltage from the inverter and the inverter is controlled by the low voltage signal generator. The boost circuit includes a low voltage output for powering the signal generator. Thus, the different portions of the circuit are interdependent. In the event of a fault, the operation of the signal generator is interrupted, thereby shutting off the boost circuit and the inverter. The interdependence of the portions of the circuit is such that the ballast is shut off quickly and easily by a semiconductor switch in a low voltage portion of the ballast. A DC blocking capacitor is in series with the lamps and a resistor is connected in parallel with the DC blocking capacitor. The ballast is started by a pulse of displacement current through the lamp filaments to the boost circuit. Since the lamp filaments must be intact, the ballast does not begin a lamp starting sequence until lamps are connected to the ballast.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
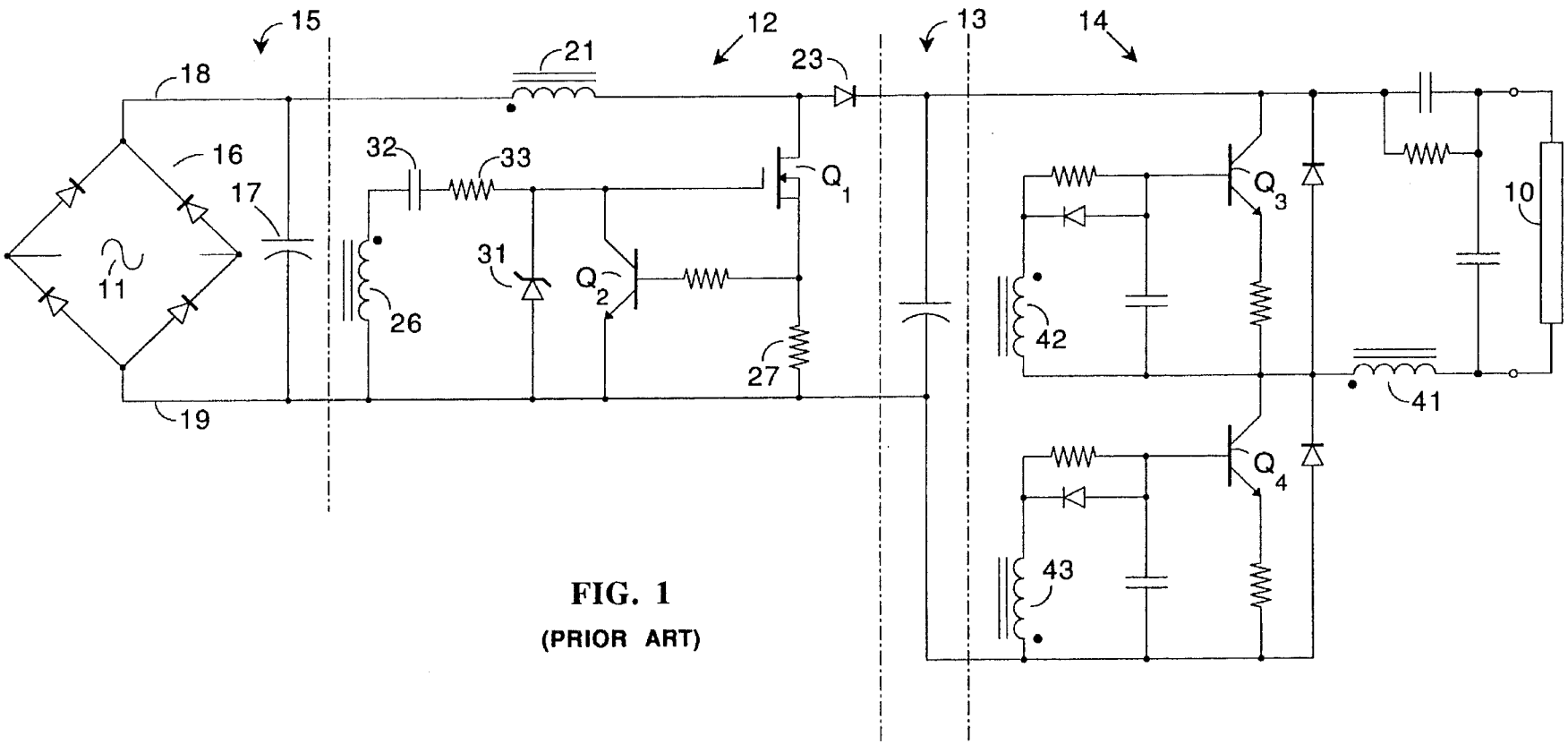
FIG. 1 (PRIOR ART)
FIG. 1 is a schematic of an electronic ballast of the prior art.

FIG. 1 illustrates the major components of an electronic ballast for connecting fluorescent lamp 10 to an AC power line, represented by waveform 11. The electronic ballast in FIG. 1 includes boost circuit 12, energy storage capacitor 13, and inverter 14. Boost circuit 12 increases the DO voltage from the rectifier and stores it on capacitor 13. Inverter 14 is powered by the energy stored in capacitor 13 and provides a high frequency, e.g. 30 khz, alternating current to lamp 10.

AC input 15 includes bridge rectifier 16 having DC output terminals connected to capacitor 17 by rails 18 and 19. If rectifier 16 were simply connected to capacitor 13, then the maximum voltage on capacitor 13 would be equal to approximately 1.4 times the r.m.s. value of the applied voltage. Instead, the voltage on capacitor 17 is increased to a higher voltage by a boost circuit including inductor 21, transistor $Q_1$, and diode 23. When transistor $Q_1$ is conducting, current flows from rail 18 through inductor 21 and transistor $Q_1$ to rail 19. When transistor $Q_1$ stops conducting, the field in inductor 21 collapses and the inductor produces a high voltage which adds to the voltage from bridge rectifier 16 and is coupled through diode 23 to capacitor 13. Diode 23 prevents current from flowing back to transistor $Q_1$ from capacitor 13.

A pulse signal must be provided to the gate of transistor $Q_1$ in order to periodically turn $Q_1$ on and off to charge capacitor 13. Inductor 26 is magnetically coupled to inductor 21 and provides feedback to the gate of transistor $Q_1$, causing transistor $Q_1$ to oscillate at high frequency, i.e. a frequency at least ten times the frequency of the AC power line, e.g. 30 khz.

Resistor 27, in series with the source-drain path of transistor $Q_1$, provides a feedback voltage which is coupled to the base of transistor $Q_2$. When the voltage on resistor 27 reaches a predetermined magnitude, transistor $Q_2$ turns on, turning off transistor $Q_1$. Resistor 27 typically has a small value, e.g. 0.5 ohms. Zener diode 31 limits the voltage on the gate of transistor $Q_1$ from inductor 26 and capacitor 32 and resistor 33 provide pulse shaping for the signal to the gate of transistor $Q_1$ from inductor 26.

In inverter 14, transistors $Q_3$ and $Q_4$ are series connected between rails 18 and 19 and conduct alternately to provide a high frequency pulse train to lamp 10. Inductor 41 is series connected with lamp 10 and is magnetically coupled to inductors 42 and 43 for providing feedback to transistors $Q_3$ and $Q_4$ to alternately switch the transistors. The oscillating frequency of inverter 14 is independent of the frequency of boost circuit 12 and is on the order of 25–50 khz. The arrangement of inverter 14 is known in the art as a half-bridge, push-pull inverter.

Figure 2:
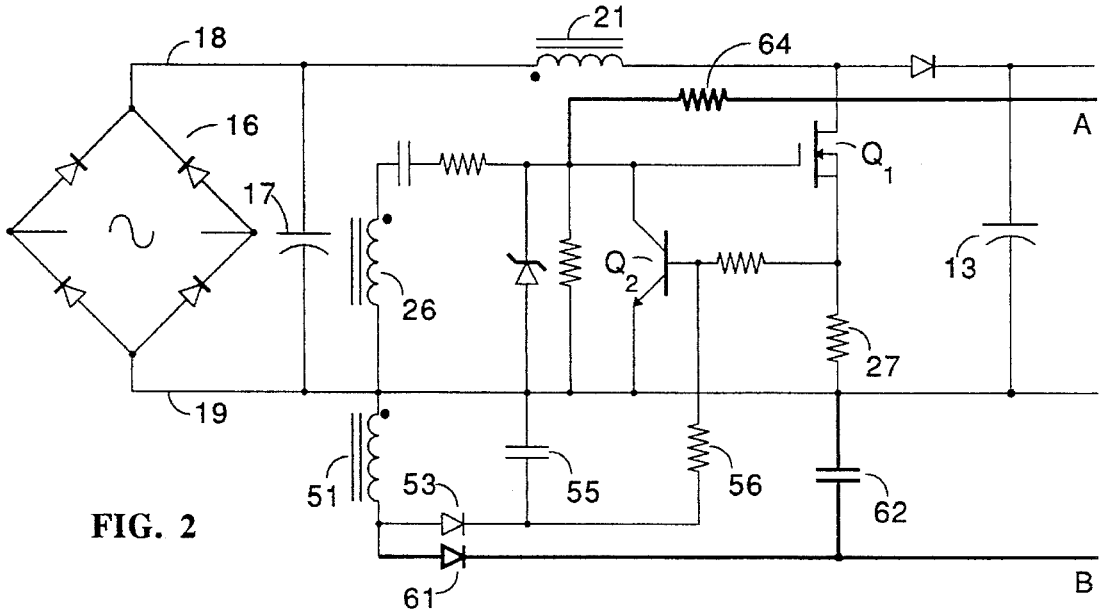
FIG. 2 is a schematic of a boost circuit constructed in accordance with the invention.
Figure 3:
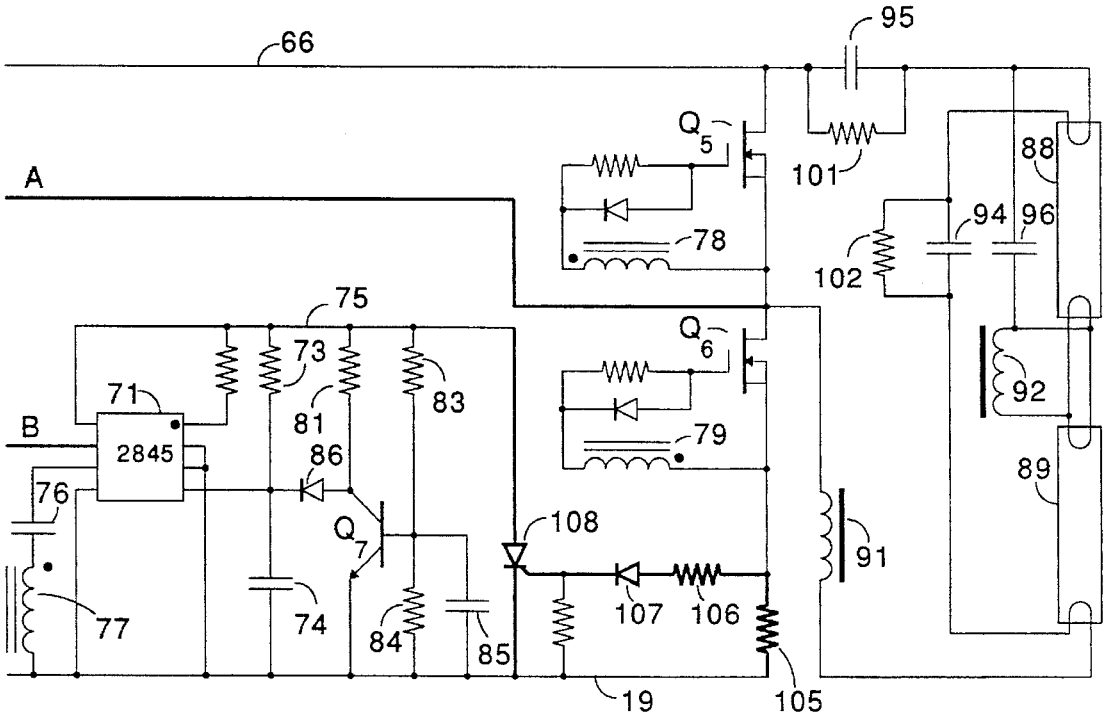
FIG. 3 is a schematic of an inverter constructed in accordance with the invention.

FIG. 2 illustrates a boost circuit constructed in accordance with a preferred embodiment of the invention in which the boost circuit provides both low voltage, e.g. 5 volts, for powering other components of the ballast, and high voltage, e.g. 300 volts, for powering one or more lamps. Some elements in FIGS. 2 and 3 are drawn in heavier line to facilitate reading the schematic.

Inductor 51 is magnetically coupled to inductors 21 and 26. The voltage induced in inductor 51 therefore includes a high frequency component from the operation of transistor $Q_1$ and a low frequency component from the ripple voltage. The voltage from inductor 51 is coupled to a ripple detector including diode 53 and capacitor 55. The rectified voltage on capacitor 55 is coupled to the control electrode of transistor $Q_2$ by resistor 56. This portion of the circuit significantly improves power factor and harmonic distortion.

The boost circuit also includes diode 61 connected to inductor 51 and capacitor 62 connected between diode 61 and rail 19. The junction between diode 61 and capacitor 62 is brought out on line B. The output from capacitor 62 is a filtered, DC voltage, e.g. 5 volts, for powering other components within the ballast.

If power is applied to the AC input of the ballast, there is no DC path through the boost circuit for causing the boost circuit to begin oscillation. Resistor 64 provides DC coupling to the gate of transistor $Q_1$ for biasing the transistor to initiate oscillation within the boost circuit. Resistor 64 has a high resistance, e.g. 270,000 ohms, and is of negligible effect once the boost circuit is oscillating. The boost circuit oscillates during each half cycle of the rectified input voltage, i.e. the boost circuit must be restarted 120 times per second with the bias provided from resistor 64. Resistor 64 is connected to line A extending to the right hand side of FIG. 2.

FIG. 3 is a continuation of the schematic of a ballast constructed in accordance with a preferred embodiment of the invention. Lines A and B correspond to lines A and B of FIG. 2. Transistors $Q_5$ and $Q_6$ are series-connected between rails 66 and 19 and are operated as a push-pull, half-bridge inverter. Transistors $Q_5$ and $Q_6$ are insulated gate field effect transistors (IGFET) instead of bipolar transistors $Q_3$ and $Q_4$ as illustrated in FIG. 1. IGFETs draw less current from the driving circuitry than bipolar transistors but their shorter switching time can cause excessive electromagnetic interference (EMI) in some applications.

Transistors $Q_5$ and $Q_6$ are driven by signal generator 71 which, in one embodiment of the invention, included a commercially available pulse width modulator chip designated 2845. In FIG. 3, pin 1 of signal generator 71 is indicated by a dot and the pins are numbered consecutively clockwise. The particular chip used to implement the invention included several capabilities which are not needed, i.e. the invention can be implemented with much simpler integrated circuits such as a 555 timer chip.

Pin 1 of signal generator 71 relates to an unneeded function and is tied high. Pins 2 and 3 relate to unneeded functions and are grounded. Pin 4 is the frequency setting input and is connected to the junction of resistor 73 and capacitor 74. Pin 5 is electrical ground for signal generator 71 and is connected to rail 19. Pin 6 of signal generator 71 is the high frequency output and is coupled through capacitor 76 to inductor 77. Inductor 77 is magnetically coupled to inductor 78 and to inductor 79. Inductor 78 is coupled between the gate and source electrodes of transistor $Q_5$. Inductor 79 is coupled between the gate and source electrodes of transistor $Q_6$. As indicated by the small dots adjacent each inductor, inductors 78 and 79 are oppositely poled, thereby causing transistors $Q_5$ and $Q_6$ to switch alternately at a frequency determined by resistor 73, capacitor 74, and the voltage on rail 75.

Signal generator 71 is powered by the low voltage on line 8 from the boost circuit in FIG. 2. Thus, one obtains a power supply for integrated circuits and other devices from a minimal number of additional components.

Pin 8 of signal generator 71 is a voltage output for providing bias to the frequency determining network including resistor 73 and capacitor 74 which are series-connected between rail 75 and rail 19. This output is connected to rail 75 to provide voltage for transistor $Q_7$ and the bias circuitry connected to transistor $Q_7$. Transistor $Q_7$ is series-connected with load resistor 81 between rail 75 and rail 19. A voltage divider network includes series-connected resistor 83 and resistor 84 between rail 75 and rail 19. The junction between resistor 83 and resistor 84 is connected to the base of transistor $Q_7$ Capacitor 85 is connected in parallel with resistor 84. When transistor $Q_7$ is not conducting, diode 86 connects resistor 81 in parallel with resistor 73 and current flows through resistor 73 and resistor 81 to capacitor 74. When transistor $Q_7$ is conducting, capacitor 74 is charged only by the current through resistor 73. Diode 86 is back biased, effectively removing resistor 81 from the circuit.

Transistor $Q_7$ and its associated bias circuitry causes the frequency of signal generator 71 to be higher when power is initially applied to the ballast ($Q_7$ is off) than when the lamps are conducting. The higher frequency temporarily reduces the output voltage while the lamp filaments warm up. Specifically, when power is first applied to the ballast, bias is applied through line A to the boost circuit, as more fully described below. When the boost circuit begins oscillation, an operating voltage is produced on line 8 causing signal generator 71 to begin operation. When a voltage is applied to rail 75 by signal generator 71, capacitor 85 begins to charge. At some point, determined by the relative values of capacitor 85, resistor 83, resistor 84, and the voltage on rail 75, the voltage on capacitor 85 exceeds the turn-on voltage of transistor $Q_7$. When transistor $Q_7$ begins conducting, the frequency of oscillation of signal generator 71 is reduced. This allows the resonant output circuit (described below) to produce the voltages needed to start and run the lamps.

The output from signal generator 71 is coupled from inductor 77 to inductors 78 and 79 for alternately switching transistors $Q_5$ and $Q_6$. As transistors $Q_5$ and $Q_6$ alternately switch, power is applied to lamps 88 and 89 through inductor 91. The power initially applied flows through the filaments of lamps 88 and 89, warming the filaments. Inductor 92 is magnetically coupled to inductor 91 and provides power for heating the filaments connected in common between lamps 88 and 89. Lamps 88 and 89 are connected in parallel with capacitor 94 which forms a resonant LC circuit with inductor 91. The operating frequency of signal generator 71 is slightly higher than the resonant frequency of inductor 91 and capacitor 94.

DC blocking capacitor 95 provides AC coupling to the lamps and blocks power to the lamps if one of the lamps should become defective and operate in what is known as a "diode" mode. Capacitor 96 provides AC coupling to the junction of lamps 88 and 89 to facilitate starting the lamps. Resistor 101 is connected in parallel with capacitor 95 and resistor 102 is connected in parallel with capacitor 94. These resistors are "bleeder" resistors in that they have a high resistance and have no effect on the normal operation of the circuit but provide a discharge path for the capacitors when power is removed from the ballast or when the ballast ceases operation in response to a fault condition.

The voltage at the junction of transistors $Q_5$ and $Q_6$ varies between the voltage on rail 66 and the voltage on rail 19 (ground potential) and does so at a rate of approximately 30,000 times per second. The pulses produced by $Q_5$ and $Q_6$ are coupled by line A through resistor 64 to the gate of transistor $Q_1$. As previously described, $Q_1$ must be triggered into oscillation for each half cycle of the AC input voltage. Since transistors $Q_5$ and $Q_6$ are oscillating at a frequency much higher than the frequency of the AC input voltage, a pulse is applied to $Q_1$ very shortly after each zero crossing of the AC input voltage. This pulse triggers $Q_1$ into conduction and initiates the oscillation of the boost circuit.

Although the boost circuit is triggered each half cycle of the AC input voltage, the frequency of the boost circuit is independent of the frequency of the inverter. This permits one to add power factor and harmonic distortion correction circuitry to the boost circuit without impairing the operation of the inverter. The need for a trigger pulse also provides a simple mechanism for shutting down the entire ballast since one need only shut off signal generator 71 to terminate operation of the entire ballast.

Transistors $Q_5$ and $Q_6$ and resistor 105 are series-connected between rail 66 and rail 19. Resistor 105 converts the current flowing through lamps 88 and 89 into a voltage which is coupled by resistor 106 and diode 107 to the gate of SCR 108. Resistor 105 consumes very little power, has a low value of resistance, and provides a simple means for sensing the current through transistor $Q_6$. A resistance of one ohm has been found suitable.

If a lamp becomes defective or if a lamp is removed, the current through transistor $Q_6$ increases, thereby increasing the voltage drop across resistor 105. The increased voltage is coupled to the gate of SCR 108, triggering the SCR into conduction. When SCR 108 conducts, rail 75 is essentially connected to rail 19. This short circuit is coupled to pin 4 of signal generator 71, shutting off the signal generator. Since signal generator 71 is shut off transistors $Q_5$ and $Q_6$ both turn off and no pulses are applied to line A. Since there are no pulses on line A, the boost circuit is also shut off. As soon as signal generator 71 stops producing output pulses, transistors $Q_5$ and $Q_6$ stop conducting, the voltage drop across resistor 105 becomes very low, and the voltage on rail 75 is insufficient to latch SCR 108 since the boost has stopped.

Unlike circuits of the prior art, a ballast constructed in accordance with the invention does not attempt to quench oscillations in a high voltage or high current portion of the ballast, i.e. switching transistors $Q_1$, $Q_5$ or $Q_6$ . Rail 75 is brought almost to almost ground potential with very little power dissipation and even that terminates quickly as the ballast shuts off. Low power components can be used and relatively few are needed in accordance with the invention. The result is a ballast that is more efficient, more compact, and less expensive than ballasts of the prior art having the same capabilities.

When lamps 88 and 89 are replaced, assuming power is still applied to the ballast, the filaments of the lamps complete a current path from rail 66 through inductor 91 and line A to the gate of transistor $Q_1$ (FIG. 2). This occurs because resistors 101 and 102 have discharged capacitors 95 and 94. When the lamps are replaced and the filaments complete the circuit, a displacement current flows from rectifier 17 through rail 18 and inductor 21 to capacitor 95, charging the capacitor. This displacement current continues through the upper filament of lamp 88 and through capacitor 94, charging capacitor 94. The displacement current continues through the lower filament of lamp 89, through inductor 91 to the junction of transistors $Q_5$ and $Q_6$ . As previously described, the junction of transistors $Q_5$ and $Q_6$ is resistively coupled to the gate of transistor $Q_1$ . $Q_1$ begins conducting and the boost circuit starts oscillating.

The displacement current occurs when power is initially applied to the ballast, or when a lamp is replaced, and produces a pulse on the output of the ballast even though the ballast is not operating. In response to the current pulse, the boost circuit begins oscillating to produce both a high voltage and a low voltage, then signal generator 71 begins producing pulses, and then the inverter begins oscillating. At a predetermined time after initial turn-on, the frequency of signal generator 71 is reduced and the lamps are operated at a frequency slightly above the resonant frequency of the LC circuit, as described above, Thus, the invention provides an electronic ballast that senses faults, shuts off quickly without dissipating large amounts of power, and remains off until the fault is corrected. It is not necessary to interrupt power to the ballast in order to restart the ballast and the ballast does not periodically produce high voltages on the output terminals while a fault condition exists. The few added components for obtaining automatic shut off do not adversely affect the efficiency of the ballast.

Having thus described the invention, it will be apparent to those of skill in the art that various modifications can be made within the scope of the invention. As previously described, other devices can be used for signal generator 71. The switching transistors can be bipolar or field effect and of either conductivity type. The number of lamps powered by the ballast is a matter of choice.

What is claimed is:

1. A fault tolerant electronic ballast for a gas discharge lamp, said ballast comprising:

an AC input circuit for receiving alternating current from a power line and producing a rectified AC voltage;

a boost circuit coupled to said AC input circuit, said boost circuit including a control input and a high voltage output, said boost circuit producing direct current pulses at said high voltage output after a trigger signal is applied to said control input;

a driven inverter coupled to said boost circuit and having an output for connection to a gas discharge lamp, said inverter converting direct current into pulses at said outputs, said pulses having a high frequency;

a signal generator coupled to said inverter for driving said inverter at said high frequency; and impedance means for coupling said pulses to said control input as said trigger signal.

2. The ballast as set forth in claim 1 and further comprising:

fault sensing circuitry coupled to said signal generator for turning off said signal generator when a fault is detected.

3. The ballast as set forth in claim 1 wherein said boost circuit also produces low voltage direct current for powering said signal generator.

4. The ballast as set forth in claim 1 wherein said inverter includes:

(i) a first semiconductor switch and a second semiconductor switch connected in series between said high voltage output and electrical ground;

(ii) an inductor and a capacitor connected in series between said high voltage output and the junction of said first semiconductor switch and said second semiconductor switch;

wherein said junction is coupled to said control input for supplying said trigger signal.

5. The ballast as set forth in claim 4 wherein a lamp is connected in parallel with said capacitor.

6. The ballast as set forth in claim 1 wherein said ballast includes a DC blocking capacitor in series with said lamp and said boost circuit is started by displacement current through said DC blocking capacitor and through the filaments of said lamp.

7. The ballast as set forth in claim 6 wherein said ballast includes a resistor in parallel with said DC blocking capacitor.

* * * * *